US006387063B1

(12) United States Patent
Elnar

(10) Patent No.: US 6,387,063 B1
(45) Date of Patent: May 14, 2002

(54) VERTICALLY-OSCILLATING SPA MASSAGER

(76) Inventor: Joseph Elnar, 2954 Rubidoux Blvd., Riverside, CA (US) 92509

( * ) Notice: Subject to any disclaimer, the term of this patent is extended or adjusted under 35 U.S.C. 154(b) by 0 days.

(21) Appl. No.: 09/432,586

(22) Filed: Nov. 3, 1999

(51) Int. Cl.[7] ..... A61H 15/00

(52) U.S. Cl. ..... 601/99; 601/98; 601/112; 601/115

(58) Field of Search ..... 601/154, 156, 601/157, 158, 97–101, 103, 104, 112–117, 55

(56) References Cited

U.S. PATENT DOCUMENTS 3,862,459 A * 1/1975 Brunette ..... 15/21 D
4,061,136 A * 12/1977 Vaniglia ..... 128/24.1
4,339,833 A * 7/1982 Mandell ..... 4/542
4,356,583 A * 11/1982 Wallasch et al. ..... 15/21 E
5,382,221 A * 1/1995 Hsu et al. ..... 601/114
5,984,883 A * 11/1999 Elnar ..... 601/86
6,039,705 A * 3/2000 Wu ..... 601/99
6,174,296 B1 * 1/2001 Wang ..... 601/114

* cited by examiner

*Primary Examiner*—Justine R. Yu
(74) *Attorney, Agent, or Firm*—Edgar W. Averill, Jr.

(57) ABSTRACT

A vertically-oscillating spa massager for use in a hydrotherapy hot tub by a bather, and having a massager component slidably and captively mounted on a vertical track of a base member mounted on the hot tub. The massager component oscillates in a vertically reciprocating manner on the vertical track preferably by means of a rotating drive arm pivotally attached to the base member at a pivot end and slidably connected at a swing end through an elongated aperture on the massager component. The rotating drive arm is preferably driven by a water driven turbine. Additionally, the massager component has at least one convex surface, preferably a roller, which is used to apply contact pressure on a bather and rollably perform the massage as the massager component oscillates.

16 Claims, 6 Drawing Sheets

VERTICALLY-OSCILLATING SPA MASSAGER

BACKGROUND OF THE INVENTION

The field of the invention generally pertains to massaging devices. The invention relates more particularly to a vertically-oscillating spa massager for use in hydrotherapy hot tubs.

Various types of spa massagers have been utilized in hydrotherapy hot tubs or whirlpool baths to therapeutically enhance the bathing experience, and promote health and well-being. They do so by soothing and relaxing sore, stiff muscles, and by relieving tension and stress around the neck, shoulder, and back areas typically incurred during the work day or week.

The back area in particular is highly susceptible to sore and stiff muscles resulting from overexertion, as well as from sitting upright for long periods of time. Moreover, these common back problems do not typically occur at discreet and isolated points. Rather, entire muscle groups at the upper or lower regions of the back along the length of the spine can experience strain and fatigue caused by daily activities.

Various adjustable and oscillating devices have been used to target and reach all the various areas of a bather's back, either to massage and relax, or to simply wash and clean the back. For example, in U.S. Pat. No. 992,905, a bath brush is disclosed having a system of pulleys manually operable by the bather. One cord is used to raise the brush, while the other is used to lower the brush. However, this manual method of adjusting the position of the brush can be difficult and onerous to operate because it requires considerable participation and effort on the part of the bather.

Additionally, in U.S. Pat. No. 4,151,623, a bathing device is shown having a water-powered rotating brush adjustably mounted on an elongated rod vertically secured to a wall. However, this bathing device also requires manual adjustment of the rotating brush to a desired height each time a different area of the back needs to be reached.

Finally, a reciprocating hydro-massage apparatus is disclosed in U.S. Pat. No. 4,339,833 using a double-helix drive screw to automatically reciprocate a jet nozzle in a vertical manner along a bather's back. The jet nozzle emits water jets to perform a massage. In a first embodiment, an electric motor turns the drive screw which causes the jet nozzle to move. In a second embodiment, the double-helix screw is held stationary, while a turbine in the jet nozzle is geared to reciprocate the jet nozzle box up and down as water passes through.

While the massage apparatus of patent '833 accomplishes its objective to provide an automatic oscillating means for performing a massage, the benefits may be limited because of the use of water jets. While serving their intended purpose, jets of heated water generally cannot transfer a high degree of pressure without irritation caused by the impingement of water. Higher pressure is sometimes desired to more effectively massage and soothe muscles. This can substantially limit the benefit of the spa massager as well as the enjoyment originally intended with such spa massagers.

BRIEF SUMMARY OF THE INVENTION

It is an object of the present invention to provide a spa massager for use in hydrotherapy hot tubs which therapeutically massages the back of a bather by means of a contact surface which oscillates in a vertically reciprocating manner.

It is a further object of the present invention to provide a spa massager as described above, which contact surface is capable of rolling movement as it oscillates in a vertically-reciprocating manner.

The present invention is for a vertically-oscillating spa massager for use in a hydrotherapy hot tub by a bather. The vertically-oscillating spa massager comprises a base member which is mountable to a hydrotherapy hot tub and which has at least one vertically-oriented track portion. The spa massager also comprises a massager means which has at least one slider portion adapted to captively and matingly slide along the corresponding vertically-oriented track portion of the base member, and at least one convex surface which effects therapeutic contact with a bather. The massager means is actuated to slide along the vertically-oriented track portion by means for vertically-oscillating the massager means.

DETAILED DESCRIPTION OF THE PREFERRED EMBODIMENTS

Figures 1, 2:
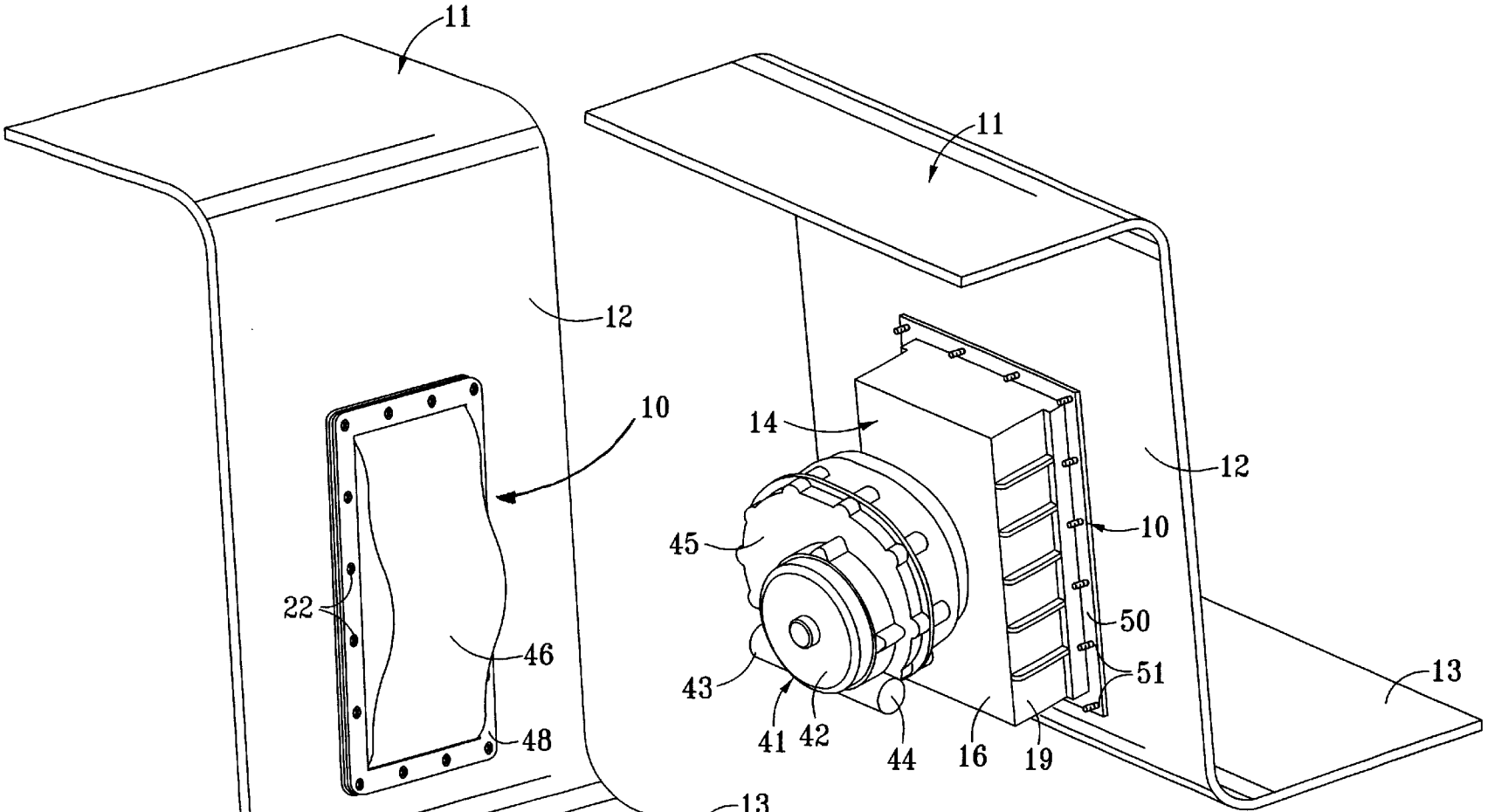
FIG. 1 is a perspective view of the vertically-oscillating spa massager finally installed in a hydrotherapy hot tub, as generally seen from the front.
FIG. 2 is a perspective view of the finally installed vertically oscillating spa massager of FIG. 1, as generally seen from the rear.
Figure 3:
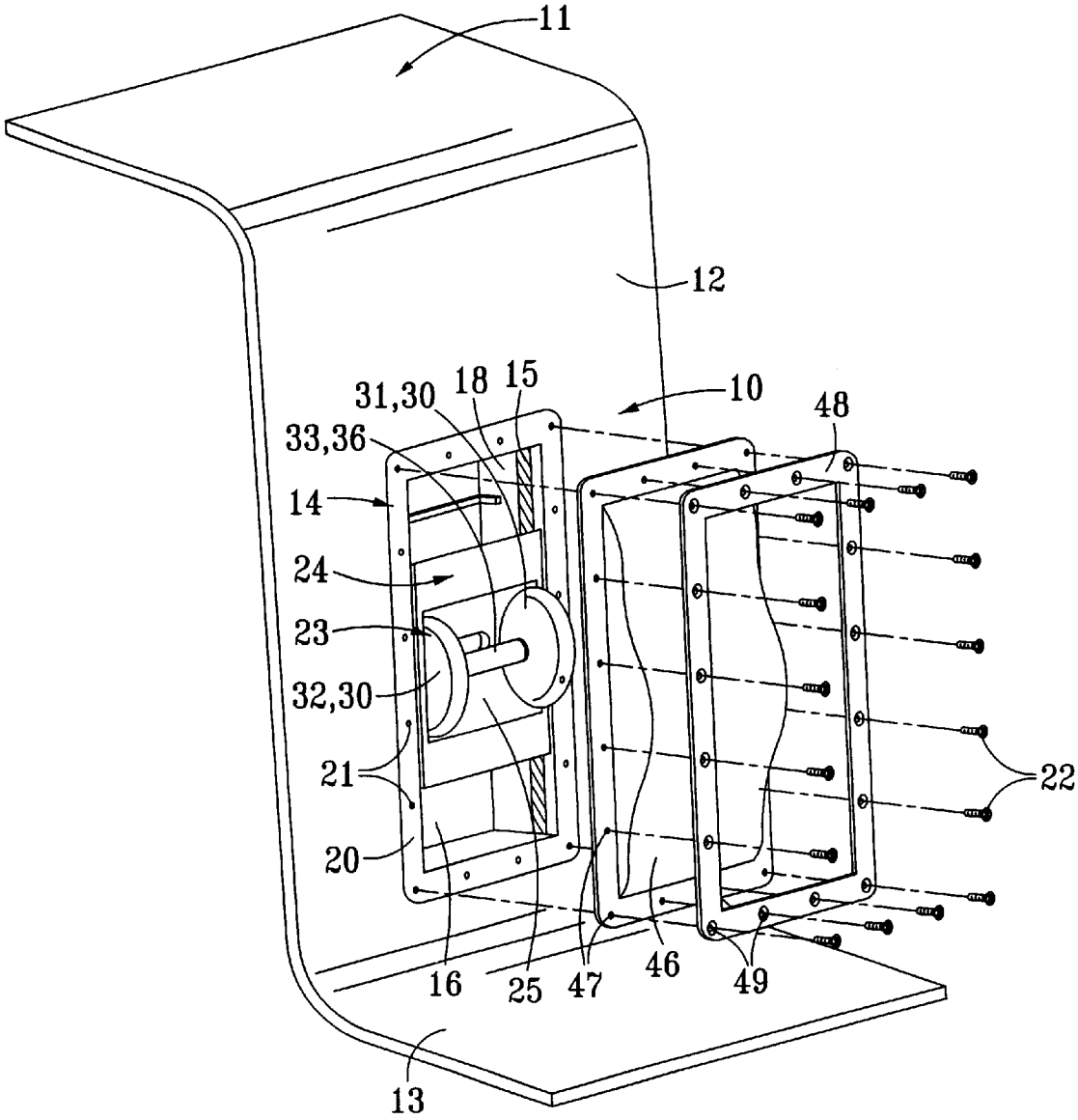
FIG. 3 is a partially exploded perspective view of the finally installed vertically-oscillating spa massager of FIG. 2, as generally seen from the front.

Referring now to the drawings, FIGS. 1 and 2 show front and rear perspective views, respectively, of the vertically-oscillating spa massager, generally indicated at reference character 10, installed in a hydrotherapy hot tub, generally indicated at reference character 11. As can be seen in FIGS. 1–3, the hydrotherapy hot tub 11 includes a backrest portion 12 and a seat portion 13. The vertically-oscillating spa massager 10 is preferably designed to be mounted in an opening (not shown) in the backrest portion 12 in a waterproof manner, such that a bather can enjoy a soothing massage while sitting on the seat portion 13 and leaning back against the backrest portion 12. Alternatively, however, the vertically-oscillating spa massager 10 may be suitably mounted directly on the backrest portion 12 without the use of an opening in the backrest portion 12.

Figure 4:
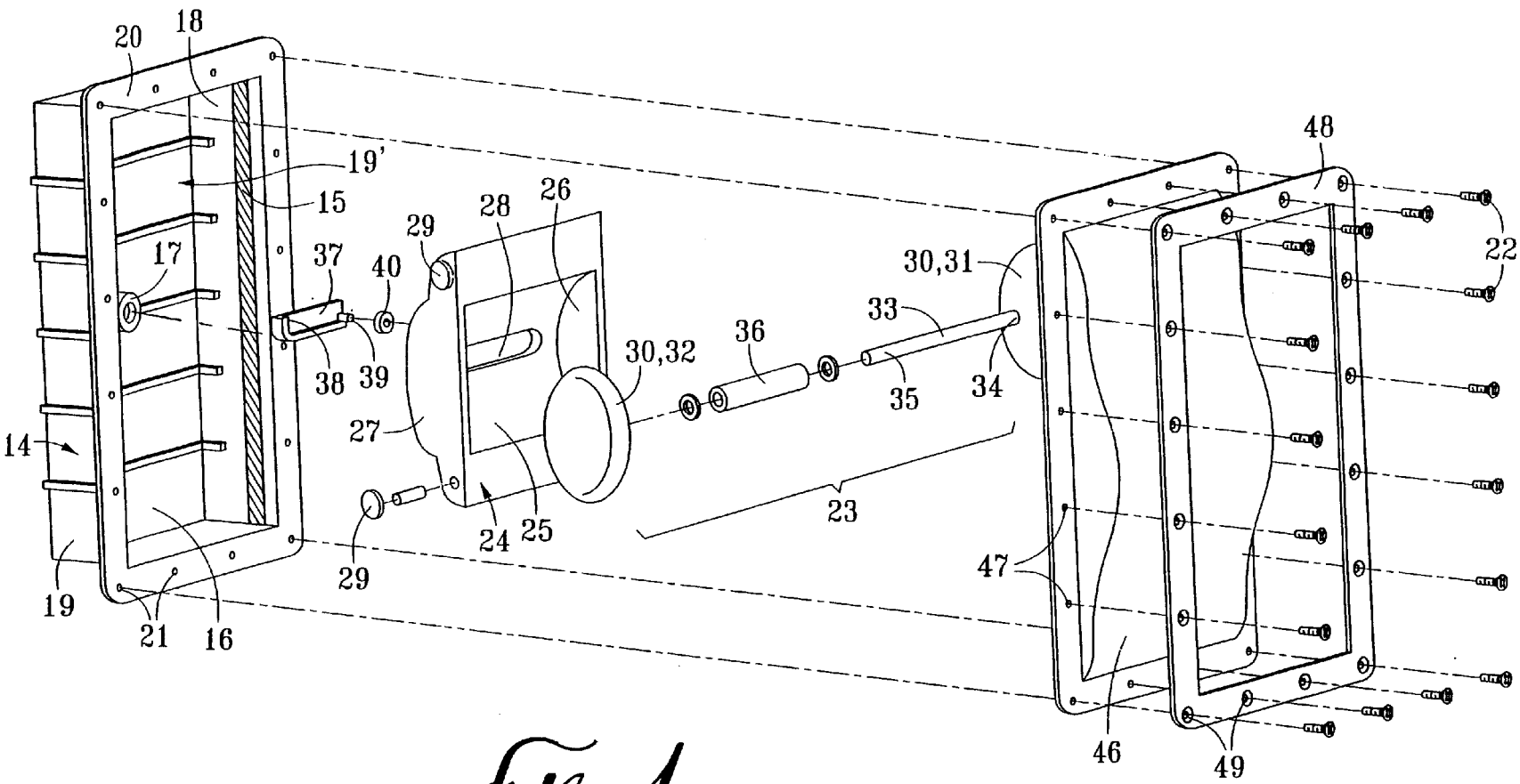
FIG. 4 is an exploded perspective view of a preferred embodiment of the vertically-oscillating spa massager.

Details of the spa massager 10 can be best seen in FIG. 4, showing an exploded perspective view of a preferred embodiment. The spa massager 10 has a base member, generally indicated by reference character 14, which preferably has a base center wall 16 affixed to two vertically-opposing base sidewalls 18, 19 which together form a track cavity 19'. Additionally, top and bottom sidewalls (not shown) may also be affixed to the base center wall 16 to partially enclose the track cavity 19'. The base member 14 also has a mounting flange 20 along the base sidewalls 18, 19 (and the top and bottom side walls, if any), having a plurality of mounting holes 21 for mounting the base member 14 to the backrest portion 12. The mounting holes 21 are pre-drilled to receive a plurality of fasteners 22, preferably screws 22. Further, the base member 14 has at least one vertically-oriented track 15, preferably a grooved channel 15 on each base sidewall 18, 19.

Figure 6:
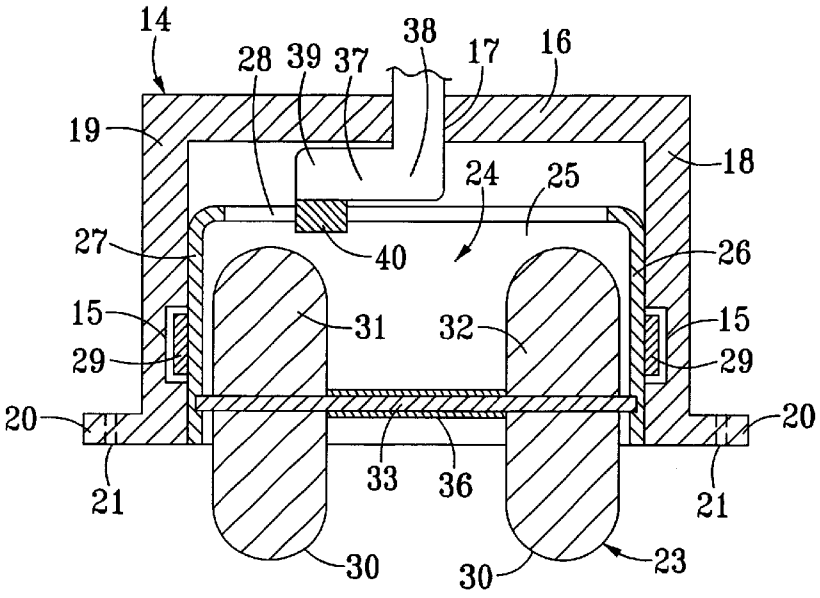
FIG. 6 is a top cross-sectional view of the vertically-oscillating spa massager taken along the line 6 of FIG. 5.
Figure 5:
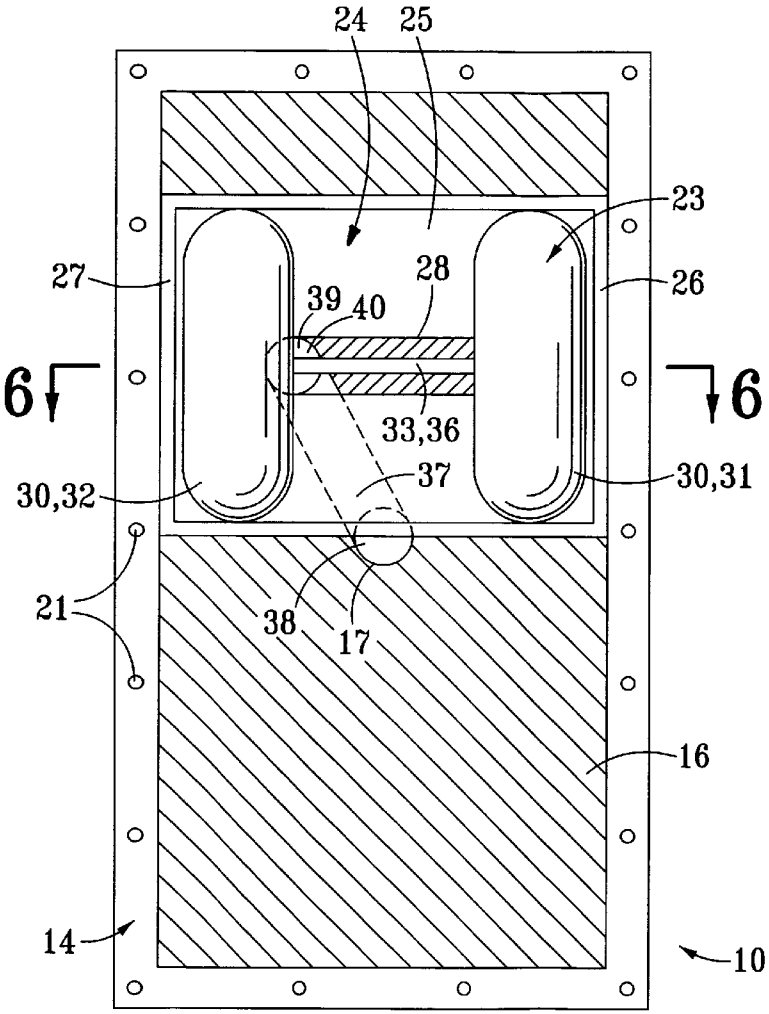
FIG. 5 is a front view of the vertically-oscillating spa massager with the flexible diaphragm removed.

Additionally, as can be seen in FIG. 4, the spa massager 10 has massager means, generally indicated by reference character 23. The massager means 23 comprises a slider portion 24 which is slidably supported on the grooved channels 15 of the base member 14. The slider portion 24 preferably has a slider center wall 25 affixed to two vertically-opposing slider sidewalls 26, 27. In a preferred embodiment, the slider center wall 25 has an elongated aperture 28 oriented normal to the grooved channels 15 (discussed in detail below). The combination slider center wall 25 and slider sidewalls 26, 27 are positioned within the track cavity 19' of the base member 14, such that sufficient clearance remains between the slider center wall 25 and the base center wall 16 to accommodate a drive arm 37 (See FIGS. 4–8C) used to produce the all oscillating motion of the slider portion 24. And as can be seen in FIGS. 4 and 6, the slider sidewalls 26, 27 preferably have oppositely directed protrusions 29 along the respective outer surfaces of the slider sidewalls 26, 27 which captively and matingly slide along the respective grooved channels 15 of the base member 14. Contact between the protrusions 29 and the grooved channels 15 preferably has a low friction quality to facilitate sliding. As shown in FIG. 4, the protrusions 29 are preferably rotatably secured to the slider sidewalls 26, 27 whereby the protrusions 29 undergo rolling contact with the grooved channels 15. However, the protrusions 29 may also be immobilized against the slider sidewalls 26, 27, whereby the protrusions 29 undergo pure sliding contact with the grooved channels 15.

Further, the massager means 23 comprises a convex surface 30 which functions to effect therapeutic contact with a bather. While the convex surface 30 can be either a stationary or dynamic surface, it has sufficiently hard and rigid properties to exert a pressure against a second surface, i.e. the back area of a bather. Preferably, as can be seen in FIGS. 3–8C, the convex surface 30 is a section of the outer surfaces of rotating roller portions 31, 32. And as can be best seen in FIG. 6 showing a top cross-sectional view of the spa massager 10 along the line 6 of FIG. 5, the convex surface 30 is that portion of the roller portions 31, 32 which protrude beyond a plane defined by the mounting flange 20. The roller portions 31, 32 preferably have a wheel or cylinder-shaped configuration with an axis of rotation normal to the grooved channels 15 of the base member 14. And the roller portions 31, 32 are rotatably secured to the slider portion 24 by rollably securing means, preferably an elongated axle 33 having two opposing ends 34, 35 which are pivotally secured to the slider sidewalls 26, 27. And preferably, a spacer 36 is positioned between the rolling portions 31, 32 over the elongated axle 33 to keep the two roller portions 31, 32 spaced apart.

As can be best seen in FIGS. 3 and 4, a diaphragm 46 preferably having a waterproof quality is secured in a waterproof manner over the entire track cavity 19', including the roller portions 31, 32 of the massager means 23. The diaphragm 46 is fabricated from a flexible material, preferably an elastomer such as polyurethane, and has a plurality of mounting holes 47 pre-drilled along its edges which align with the pre-drilled mounting holes 21 of the base member 14. Preferably, a face plate 48 also having a plurality of pre-drilled mounting holes is used to secure the edges of the diaphragm 46 to the base member 14 and a back plate 50 (see FIG. 2).

Finally, as best shown in FIGS. 2 and 4, the spa massager 10 has means for oscillating the massager means 23 in a vertically-reciprocating manner. The means for oscillating includes the drive arm 37 located in-between the base center wall 16 and the slider center wall 25. The drive arm 37 has a pivot end 38, and a swing end 39 having a drive pin 40 extending through the elongated aperture 28 oriented generally normal to the grooved channels 15 of the base member 14. While the elongated aperture 28 is ideally oriented normal to the grooved channels 15, it can also be positioned at various angles from true normal, to produce variations in dwell of the oscillating motion of the slider portion 24. However, because angular variations of the elongated aperture 28 can produce greater loads and stresses on the drive arm 37 depending on the drive arms 37 position, it is thereby advantageous to have the elongated aperture 28 as close to true normal as possible.

The pivot end 38 of the drive arm 37 partially extends through the center aperture 17 of the base center wall 16 and preferably connects to a gearbox 45 enclosing a gear train known and used in the relevant art to reduce speed, and generate torque. Preferably, the gearbox 45 is suitably geared to a water turbine 42 having an inlet 43 and an outlet 44. The turbine 42 is driven by water pumped from a water source by a water pump (not shown) driven by a motor (not shown). The water pump preferably has an intake supplied to the source of water, and an exhaust connected to the inlet 43 of the turbine 42. In this manner, the water pump feeds water at a high pressure to the inlet 43 of the turbine 42 which then exits from the outlet 44 preferably as jets of water into the hot tub 11. The pressurized water thereby drives the water turbine 42 which rotates the drive arm 37 via the gearbox 45. Alternatively, turbine 42 can be an air driven turbine.

Figure 7C:
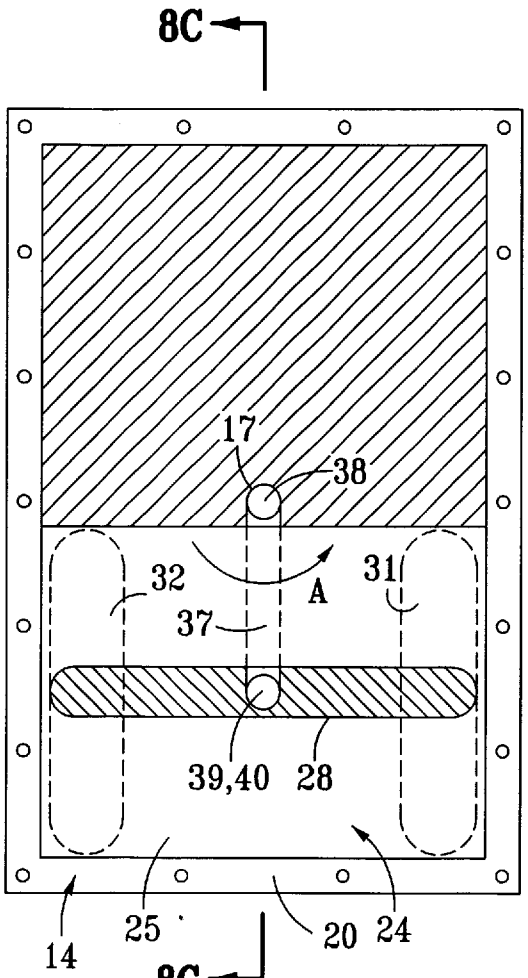
FIG. 7C is a front dynamic view of the vertically-oscillating spa massager following FIG. 7B with the drive arm rotated 180 degrees from top dead center.
Figure 7B:
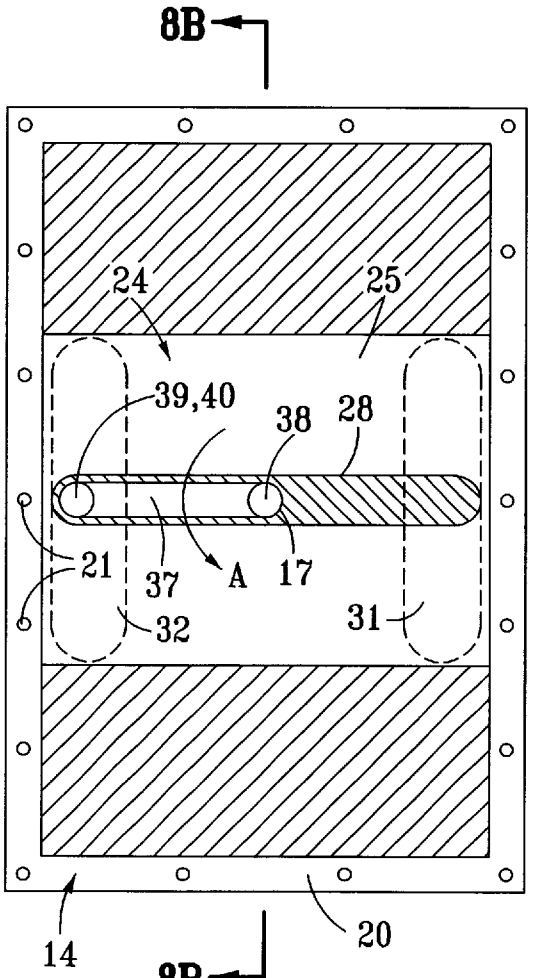
FIG. 7B is a front dynamic view of the vertically-oscillating spa massager following FIG. 7A with the drive arm rotated 90 degrees from top dead center.
Figure 7A:
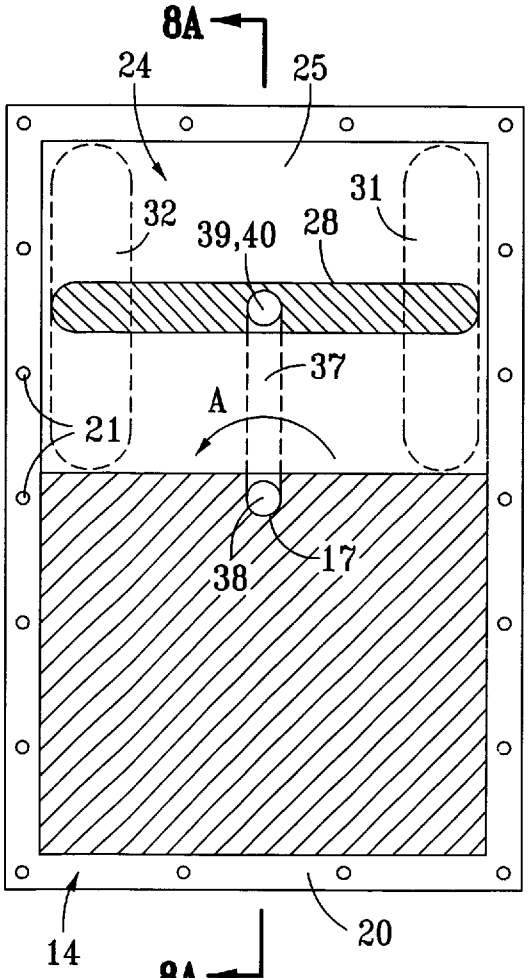
FIG. 7A is a front dynamic view of the vertically-oscillating spa massager with the drive arm at a top dead center position.

In this manner, the dynamic oscillating motion of the spa massager 10 during operation is shown in FIGS. 7A–8C. FIGS. 7A–7C show front dynamic views of the spa massager 10 with the drive arm 37 at different positions of its stroke cycle. FIG. 7A shows the drive arm 37 at an initial reference position known as top dead center (TDC). As the drive arm 37 begins to rotate, the drive pin 40 at the swing end 39 of the drive arm 37 exerts a normally directed force along an inner edge of the elongated aperture 28 (See FIGS. 7B and 7C). This normal force compels the slider portion 24 to slide along the grooved channels 15 of the base member 14. As the drive arm 37 rotates, the drive pin 40 moves along the elongated aperture 28. In FIGS. 7A and 7C, the swing end 39 is located at a midpoint of the elongated aperture 28.

However, in FIG. 7B the swing end 39 is located at a distal end of the elongated aperture 28. Correspondingly, the slider portion 24 is vertically translated from an uppermost location (FIG. 7A) to a lowermost location (FIG. 7C) along the track cavity 19'.

Figure 8C:
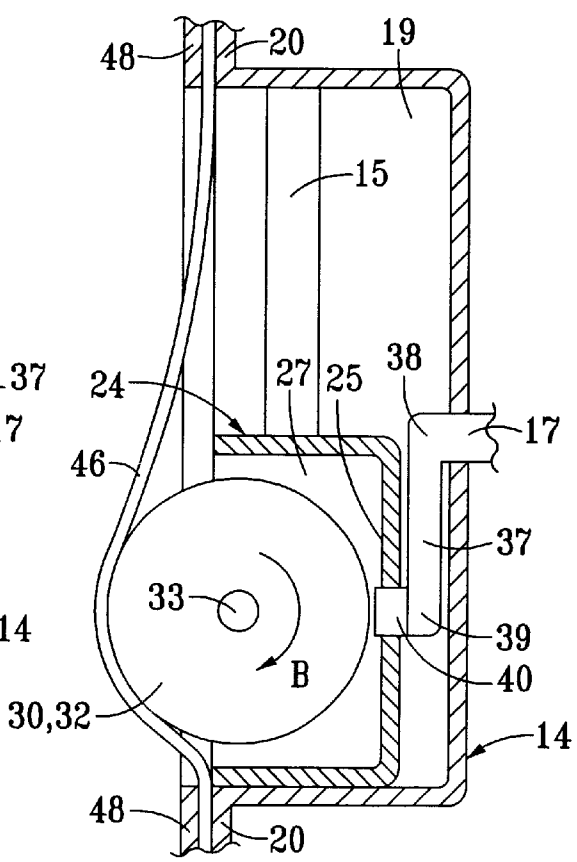
FIG. 8C is a side cross-sectional view of the vertically-oscillating spa massager taken along the line 8C of FIG. 7C, with the flexible diaphragm secured.
Figure 8B:
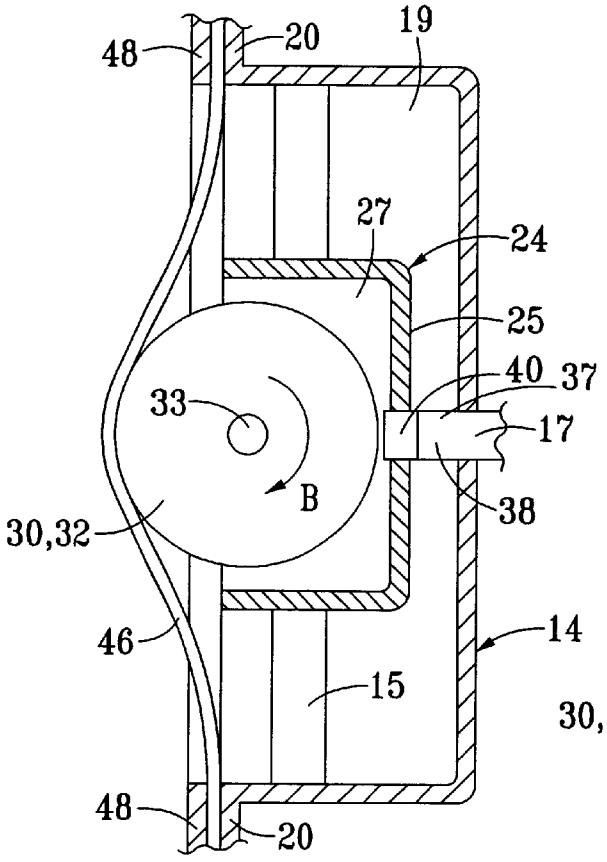
FIG. 8B is a side cross-sectional view of the vertically-oscillating spa massager taken along the line 8B of FIG. 7B, with the flexible diaphragm secured.
Figure 8A:
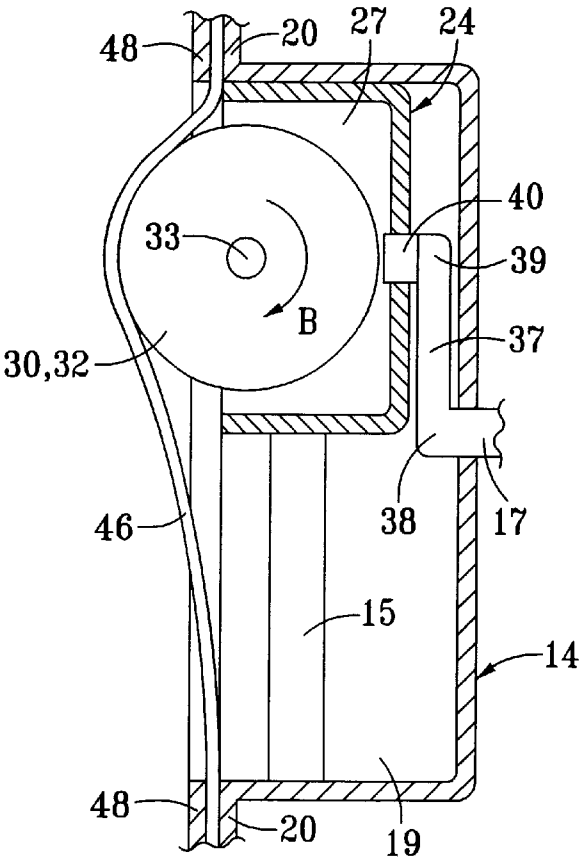
FIG. 8A is a side cross-sectional view of the vertically-oscillating spa massager taken along the line 8A of FIG. 7A, with the flexible diaphragm secured.

FIGS. 8A–8C further illustrates the dynamic rolling motion of the roller portions 31, 32, as the slider portion 24 is oscillated by the drive arm 37. During operation of the spa massager 10, a bather will lean against the roller portion 31, 32. However, the bathers back will directly or indirectly contact the roller portions 31, 32 depending on whether the flexible diaphragm 46 is used or not. FIGS. 8A–C illustrate operation with the flexible diaphragm 46. In either case, however, the roller portions 31, 32 will undergo a rolling motion against a second surface, either the back area of the bather directly, or the flexible diaphragm 46. In this manner, a wide range of pressure points can be targeted as the roller portion vertically-oscillates to massage a bathers back.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A vertically oscillating spa massager for use by a bather in a hydrotherapy hot tub having a backrest portion, said vertically oscillating spa massager comprising:

at least two vertically oriented track portions adapted to be mounted on the backrest portion of the hydrotherapy hot tub;

a slider portion adapted to captively and matingly slide along said at least two vertically-oriented track portions, said slider portion having at least one massaging surface; and means for moving said slider portion in a reciprocating manner along said at least two vertically-oriented track portions; and wherein said slider portion has an elongated aperture oriented generally normal to said at least one vertically-oriented track portion; and wherein said means for moving said slider portion in a reciprocating manner comprises:

a drive arm having a pivot end, and a swing end having a drive pin partially and slidably extending through the elongated aperture of said slider portion; and means for driving the drive arm, said means for driving the drive arm connected to the drive arm at the pivot end, whereby when the drive arm is actuated by the means for driving the drive arm, said slider portion slidably moves along said at least two vertically-oriented track portions in a reciprocating manner.

2. A vertically-oscillating spa massager as in claim 1, further comprising a flexible diaphragm having a spa surface and a back surface, said flexible diaphragm held over said slider portion whereby the at least one massaging surface abuts the back surface of said flexible diaphragm to distort said flexible diaphragm, whereby when a bather contacts the spa surface of the flexible diaphragm a massaging movement is imparted to the bather.

3. A vertically-oscillating spa massager as in claim 2, wherein said flexible diaphragm is waterproof and is held over said slider portion in a water-tight manner.

4. A vertically-oscillating spa massager as in claim 3, wherein said at least one vertically-oriented track portion is mounted in an opening in the backrest portion of said hydrotherapy hot tub; and wherein said flexible diaphragm is further mounted over the opening of the backrest portion of said hydrotherapy hot tub in a water-tight manner.

5. A vertically-oscillating spa massager as in claim 1, wherein the at least one massaging surface is a convex surface.

6. A vertically-oscillating spa massager as in claim 5, wherein the convex surface is a section of an outer surface of a roller portion rotatably and captively secured to said slider portion by rollably securing means.

7. A vertically-oscillating spa massager as in claim 6, wherein the roller portion has an axis of rotation normal to said at least one vertically-oriented track portion, and a circular cross-section when viewed along the axis of rotation.

8. A vertically-oscillating spa massager as in claim 7, wherein the rollably securing means is an elongated axle partially extending through the roller portion along the axis of rotation, the elongated axle having two opposing ends pivotally secured to said slider portion, thereby enabling the roller portion to rotate about the elongated axle.

9. A vertically-oscillating spa massager as in claim 8, further comprising a flexible diaphragm having a spa surface and a back surface, said flexible diaphragm held over said slider portion whereby the roller portion abuts the back surface of said flexible diaphragm to distort said flexible diaphragm, and to thereby enable the roller portion to roll on the back surface of said flexible diaphragm.

10. A vertically-oscillating spa massager for use by a bather in a hydrotherapy hot tub having a backrest portion, said vertically-oscillating spa massager comprising:

at least one vertically-movable massager adapted to be mounted on the backrest portion of said hydrotherapy hot tub;

means for moving said at least one vertically-movable massager;

a flexible diaphragm held over said at least one vertically-movable massager, said flexible diaphragm having a spa surface and a back surface abutted by said at least one vertically-movable massager thereby distorting said flexible diaphragm, whereby when a bather contacts the spa surface of the flexible diaphragm, a massaging movement is imparted to the bather;

wherein said at least one vertically-movable massager comprises at least two vertically-oriented track portions adapted to be mounted on the backrest portion of said hydrotherapy hot tub and a slider portion adapted to captively and matingly slide along each of the at least two vertically-oriented track portions, said slider portion having at least one massaging surface abutting the back surface of said flexible diaphragm, thereby distorting said flexible diaphragm; and wherein said means for moving said at least one vertically-movable massager moves the slider portion along the at least two vertically-oriented track portions; and wherein the slider portion has an elongated aperture oriented generally normal to the at least two vertically-oriented track portions; and wherein said means for moving the at least one vertically-movable massager comprises:

a drive arm having a pivot end, and a swing end having a drive pin partially and slidably extending through the elongated aperture of the slider portion; and means for driving the drive arm, said means for driving the drive arm connected to the drive arm at the pivot end, whereby when the drive arm is actuated by the means for driving the drive arm, said slider portion slidably moves along the at least one vertically-oriented track portion in a reciprocating manner.

11. A vertically-oscillating spa massager as in claim 10, wherein said flexible diaphragm is waterproof and is held over said at least one vertically-moving massager in a water-tight manner.

12. A vertically-oscillating spa massager as in claim 11, wherein said at least one vertically-movable massager is mounted in an opening in the backrest portion of said hydrotherapy hot tub; and wherein said flexible diaphragm is further mounted over the opening of the backrest portion of said hydrotherapy hot tub in a water-tight manner.

13. A vertically-oscillating spa massager as in claim 10, wherein the at least one massaging surface abutting the back surface of said flexible diaphragm is a convex surface.

14. A vertically-oscillating spa massager as in claim 13, wherein the convex surface is a section of an outer surface of a roller portion rotatably and captively secured to the slider portion by rollably securing means.

15. A vertically-oscillating spa massager as in claim 14, wherein the roller portion has an axis of rotation normal to the at least one vertically-oriented track portion, and a circular cross-section when viewed along the axis of rotation.

16. A vertically-oscillating spa massager as in claim 15, wherein the rollably securing means is an elongated axle partially extending through the roller portion along the axis of rotation, the elongated axle having two opposing ends pivotally secured to the slider portion, thereby enabling the roller portion to roll on the back surface of said flexible diaphragm.

* * * * *